United States Patent [19]

Klöcker et al.

[11] Patent Number: 5,048,573

[45] Date of Patent: Sep. 17, 1991

[54] NEEDLE HOLDER INSERT FOR LENO EDGE FORMING DEVICE

[75] Inventors: Heinrich J. Klöcker, Borken; Werner Wanning, Südlohn, both of Fed. Rep. of Germany

[73] Assignee: Klocker-Entwicklungs-GmbH, Borken/Westf., Fed. Rep. of Germany

[21] Appl. No.: 419,889

[22] Filed: Oct. 11, 1989

[30] Foreign Application Priority Data

Oct. 14, 1988 [DE] Fed. Rep. of Germany ... 8812937[U]

[51] Int. Cl.[5] ..... D03C 7/00

[52] U.S. Cl. ..... 139/54

[58] Field of Search ..... 139/50-54, 139/91, 93, 448, 430

[56] References Cited

U.S. PATENT DOCUMENTS

| | | | |
|---|---|---|---|
| 2,918,945 | 12/1959 | Hall | 139/54 |
| 3,795,261 | 3/1974 | Serturini | 139/54 |
| 4,324,437 | 4/1982 | Narang | 305/54 X |
| 4,357,964 | 11/1982 | Kohler | 139/448 |
| 4,371,008 | 2/1983 | Freisler | 139/448 |
| 4,671,327 | 6/1987 | Klocker | 139/54 |
| 4,715,408 | 12/1987 | Eisenlohr | 139/54 |

FOREIGN PATENT DOCUMENTS

| | | | |
|---|---|---|---|
| 7931872 | 11/1979 | Fed. Rep. of Germany | |
| 2083085 | 3/1982 | United Kingdom | 139/54 |

*Primary Examiner*—Andrew M. Falik

*Attorney, Agent, or Firm*—Collard, Roe & Galgano

[57] ABSTRACT

A device for forming a leno edge has two reciprocally operated weaving shafts. There is a thread guiding element mounted on one weaving shaft. A needle holder has two parallel substantially U-shaped plastic frame rails arranged on the other weaving shaft, and each needle holder supports a thread guiding element. Each of the frame rails has a replaceable magnetic metal rail insert on its side facing the thread guiding element.

4 Claims, 3 Drawing Sheets

NEEDLE HOLDER INSERT FOR LENO EDGE FORMING DEVICE

BACKGROUND OF THE INVENTION

1. Field of the Invention

The present invention relates to a device for forming a leno edge comprising two reciprocally operated weaving shafts; a thread guiding element mounted on one weaving shaft; and a needle holder having two parallel substantially U-shaped frame rails arranged on the other weaving shaft, with the needle holder supporting a thread guiding element.

2. The Prior Art

A device of the type mentioned above is known, for example, from German utility patent 79 31 872. It has been found that these frame rails are subjected to much wear especially when the magnets arranged in the thread guiding elements come into direct contact with the frame rail. When the frame rails of a needle holder are worn to such an extent that the thread guiding element is no longer properly guided, the risk of weaving flaws is created. Then the complete needle holder has to be replaced, which is expensive.

SUMMARY OF THE INVENTION

It is an object of the invention to solve the above-noted problem by creating a needle holder subjected to less wear.

This is accomplished according to the present invention by providing the frame rail with an insert on its side facing the thread guiding element. This frame rail can, for example, be a metal rail. In particular, a device for forming a leno edge is provided which comprises two reciprocally operated weaving shafts, a thread guiding element mounted on one weaving shaft; a needle holder having two parallel, substantially U-shaped from rails being arranged on the other weaving shaft; said needle holder supporting another thread guiding element; and each of said frame rails having an insert on its side facing the thread guiding element.

By having this insert, wear on the frame rails themselves is avoided. When the metal rail is worn, it can be replaced without any problems. For holding the metal rail in the frame rails, a groove is arranged in each case in the shank base of a shank of the U-shaped frame rail, such groove serving the purpose of receiving and guiding the metal rail.

According to the prior art, because the frame rail always had to be metallic for magnetically braking the thread guiding element, it was not possible to use frame rails made of plastic material. According to the present invention, by using a metal rail in the frame rail, it is now possible to use a frame rail made of a plastic material. Magnetic braking of the thread guiding element now takes place in cooperation with the metal rail. Plastic frame rails have the advantage of a lower weight, which permits increasing the number of cycles of the weaving machine.

Metal rails, which, according to the state of the prior art, are only nickel-plated for protecting them against rust, have the additional drawback that they form rust quickly when used in wet weaving. Such rusting is prevented with frame rails made of a plastic material. The metal rail according to the invention preferably consists of stainless, but magnetic, steel.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENT

Figure 1:
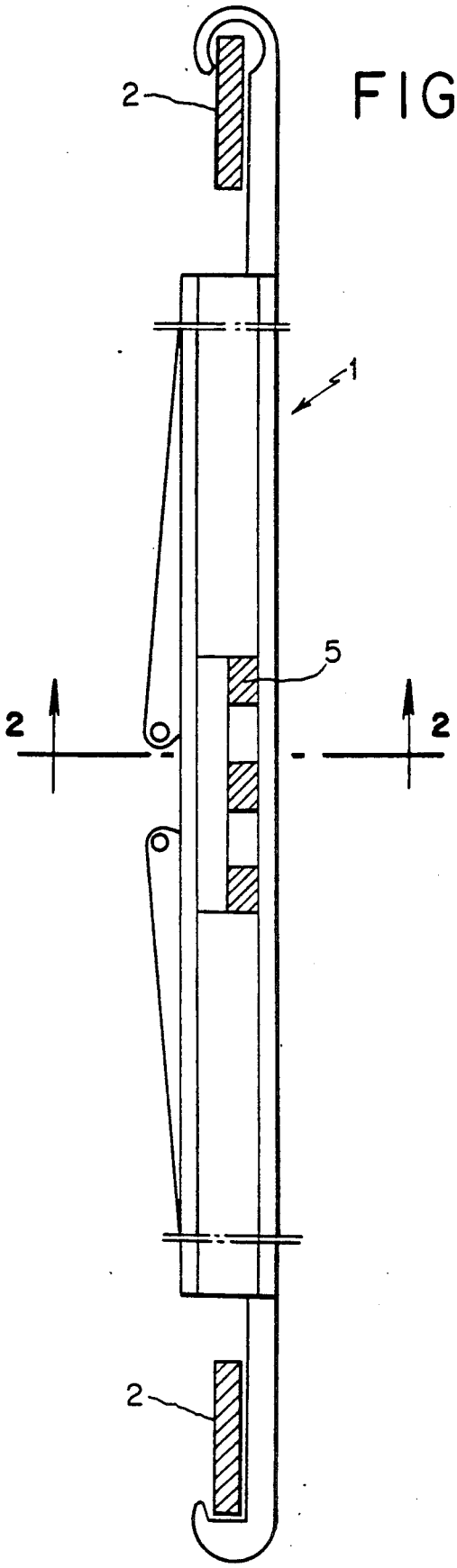
FIG. 1 shows a side view of the device for forming a leno edge according to the invention.

According to FIG. 1, a device for forming a leno edge comprises two reciprocally operated weaving shafts, whereby a needle holder is arranged on one weaving shaft, and the other weaving shaft has a thread guiding device. The second weaving shaft with the thread guiding device arranged thereon has been omitted in FIG. 1 so as to permit a better general view of the invention.

Figure 2:
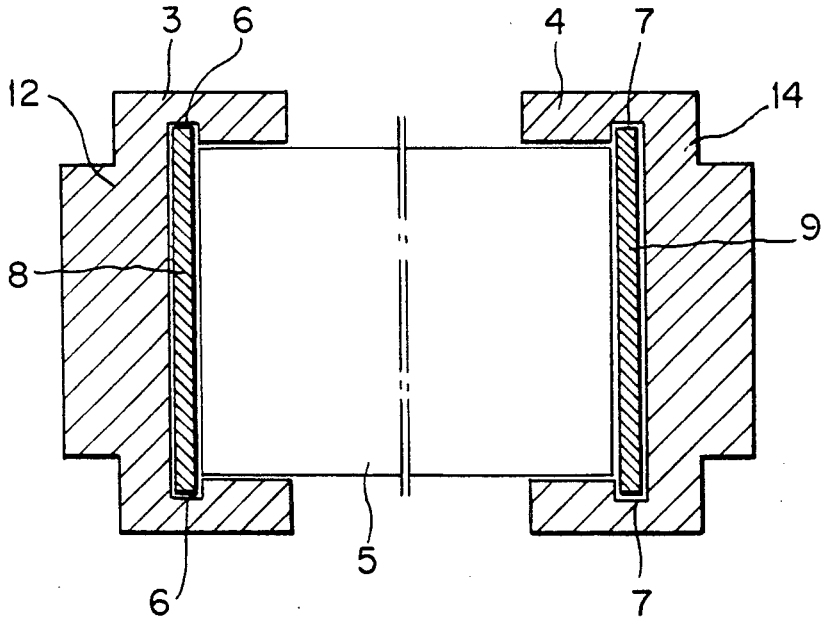
FIG. 2 is a sectional view along line 2—2 of FIG. 1 of the two parallel frame rails of a needle holder with the needles being omitted.
Figure 3:
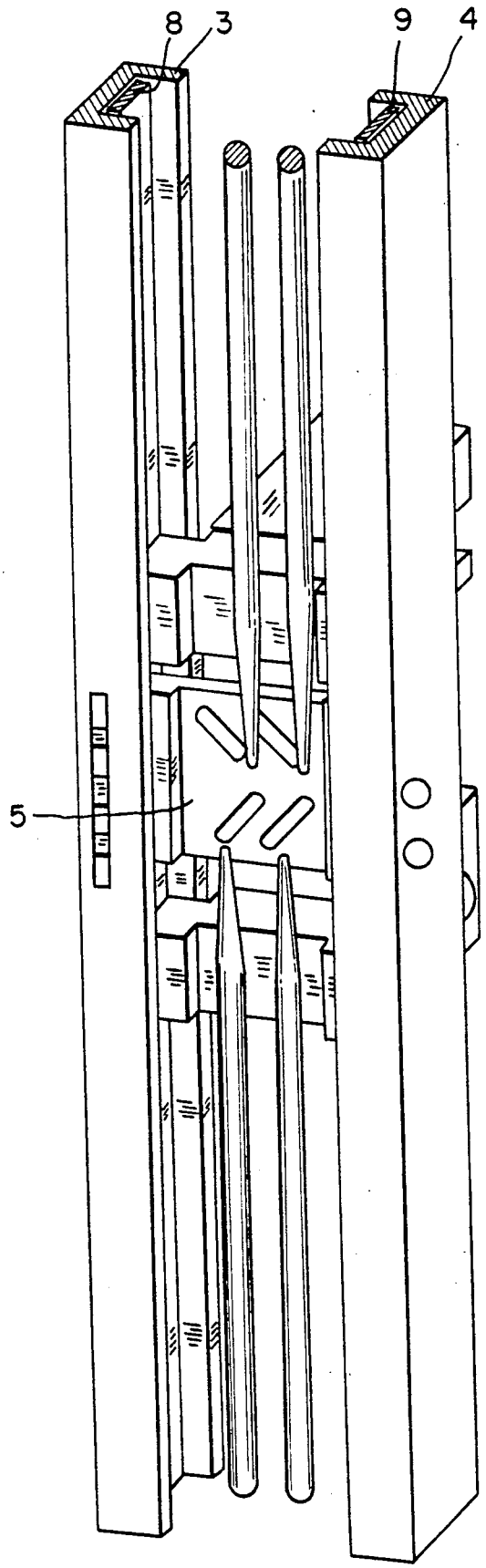
FIG. 3 is a perspective view of the device shown in FIGS. 1 and 2.

According to FIG. 1, the needle holder denoted as a whole by reference numeral 1 is arranged on the weaving shaft 2. As shown in FIG. 2, the needle holder 1 includes two parallel frame rails 3 and 4 which serve to guide the thread guiding element 5. Each frame rail 3 or 4, which is substantially U-shaped, has a groove 6 and 7, respectively, disposed in the base of each shank. The metal rails 8 and 9 are disposed in the grooves 6 and 7, respectively. In other words, each frame rail 3 or 4 has a shank base 12 or 14 respectively, and wherein the means for holding the metal rail 8 or 9 comprises a groove 6 or 7 respectively, in the shank base 12 or 14 of each frame rail. Thus the thread guiding element 5 which is guided within the two frame rails 3 and 4 is not directly in contact with the frame rails. Instead element 5 is contacted on both sides by the metal rails 8 and 9 which are replaceable and magnetic. When the metal rails are worn, they can be replaced by new ones in a simple way.

Preferably the frame rails 3 and 4 are made of a plastic, such as a thermoplastic material for example, a polyolefin like polyethylene or polypropylene, or are made of a thermosetting material such as a phenol formaldehyde resin, or styrene butadiene copolymers.

While only one embodiment of the present invention has been shown and described, it is to be understood that many changes and modifications may be made thereunto without departing from the spirit and scope of the invention as defined in the appended claims.

What is claimed is:

1. A device for forming a leno edge comprising:

two reciprocally operated weaving shafts;

a thread guiding element mounted on one weaving shaft;

a needle holder having two parallel, substantially U-shaped plastic frame rails being arranged on the other weaving shaft;

said needle holder supporting another thread guiding element; and each of said frame rails having a replaceable magnetic metal rail insert on its side facing the thread guiding element.

2. The device of claim 1, wherein said frame rail has means for holding said metal rail.

3. The device of claim 2, wherein each frame rail has a shank base and wherein said means for holding said metal rail comprises a groove in said shank base of each frame rail.

4. The device of claim 1, wherein the metal rail comprises a magnetic, stainless, steel.

* * * * *